US008388373B2

(12) United States Patent
Wang et al.

(10) Patent No.: US 8,388,373 B2
(45) Date of Patent: Mar. 5, 2013

(54) CONNECTOR WITH MOVABLE SOLDERING ATTACHMENTS

(75) Inventors: Hung-Chi Wang, Taoyuan Country (TW); Mei-Chuan Yang, Taoyuan Country (TW)

(73) Assignee: Proconn Technology Co., Ltd., Taoyuan Country (TW)

( * ) Notice: Subject to any disclaimer, the term of this patent is extended or adjusted under 35 U.S.C. 154(b) by 269 days.

(21) Appl. No.: 13/014,233

(22) Filed: Jan. 26, 2011

(65) Prior Publication Data

US 2012/0190221 A1 Jul. 26, 2012

(51) Int. Cl.
*H01R 12/00* (2006.01)

(52) U.S. Cl. ..... 439/570; 439/83

(58) Field of Classification Search ..... 439/570, 439/569, 83

See application file for complete search history.

(56) References Cited

U.S. PATENT DOCUMENTS

| | | | | |
|---|---|---|---|---|
| 4,056,302 | A * | 11/1977 | Braun et al. | 439/709 |
| 4,738,631 | A * | 4/1988 | Takahashi et al. | 439/248 |
| 4,927,372 | A * | 5/1990 | Collier | 439/83 |
| 4,992,056 | A * | 2/1991 | Douty et al. | 439/83 |
| 5,109,269 | A * | 4/1992 | Holzman | 257/700 |
| 5,334,031 | A * | 8/1994 | Schmidt | 439/83 |
| 6,155,845 | A * | 12/2000 | Lin et al. | 439/83 |
| 6,517,378 | B2 * | 2/2003 | Fumikura | 439/570 |
| 6,530,787 | B2 * | 3/2003 | Harting et al. | 439/83 |
| 6,644,983 | B2 * | 11/2003 | Recktenwald et al. | 439/75 |
| 6,875,025 | B2 * | 4/2005 | Hsu et al. | 439/71 |
| 6,955,545 | B1 * | 10/2005 | Morana et al. | 439/83 |
| 7,001,190 | B2 * | 2/2006 | Morana et al. | 439/81 |
| 7,056,133 | B2 * | 6/2006 | Iwasaki | 439/83 |
| 7,217,143 | B2 * | 5/2007 | Yang et al. | 439/83 |
| 7,413,451 | B2 * | 8/2008 | Jeon | 439/83 |
| 7,530,820 | B2 * | 5/2009 | Jeon | 439/83 |
| 7,717,716 | B2 * | 5/2010 | Dahms | 439/63 |
| 7,950,963 | B2 * | 5/2011 | Mizukami et al. | 439/607.07 |
| 8,192,208 | B2 * | 6/2012 | Tamura et al. | 439/83 |
| 2012/0190221 | A1 * | 7/2012 | Wang et al. | 439/83 |

* cited by examiner

*Primary Examiner* — Neil Abrams
(74) *Attorney, Agent, or Firm* — WPAT, P.C.; Anthony King

(57) ABSTRACT

A connector soldered to a PCB has an insulating housing of which two opposite ends are recessed to form a pair of holding recesses, terminals mounted in the insulating housing with soldering portions projected out of a bottom of the insulating housing, a pair of supporting members mounted to two opposite ends of the insulating housing and a pair of supporting members. A bottom of the supporting member extends perpendicularly to form an inserting slice having a portion thereof punched sideward to form a projection. The positioning member mounted to the inserting slice has a soldering tail and a base slice having two opposite ends thereof bent sideward and then extended toward each other to form a pair of clasping portions. A guiding slot is opened in the base portion for receiving the projection. The projection can move up and down in the guiding slot to adjust the position of the positioning member to keep the soldering portions and the soldering tails level even when there is tolerance in production.

6 Claims, 3 Drawing Sheets

CONNECTOR WITH MOVABLE SOLDERING ATTACHMENTS

BACKGROUND OF THE INVENTION

1. Field of the Invention

The present invention relates to a connector, and more particularly to a connector capable of ensuring a steady connection between terminals thereof and a printed circuit board (PCB).

2. The Related Art

Referring to FIGS. 5-6, a conventional connector 100' has an insulating housing 10', a plurality of terminals 20' mounted in the insulating hosing 10' and each having a soldering portion 21' projecting out of a bottom of the insulating housing 10' for being soldered with a PCB, a pair of latch members 30' mounted in two opposite ends of the insulating housing 10' respectively and further projecting forward out of the insulating housing 10', and a pair of positioning members 40' mounted on fronts of the latch members 30' respectively. The positioning member 40' has a pair of soldering plates 41' and a soldering tail 42' of substantially inverted-U shape linking the two soldering plates 41'. The soldering plates 41' are soldered with the PCB so as to fix the latch member 30' with the PCB. However, it is difficult to keep the two soldering plates 41' always level with the soldering portions 21' due to the tolerance in production.

SUMMARY OF THE INVENTION

Accordingly, an object of the present invention is to provide a connector soldered to a PCB. The connector includes an insulating housing having two opposite ends of a front side thereof recessed rearward to form a pair of holding recesses, a plurality of terminals assembled in the insulating housing, a holding member inserted in the holding recess, a positioning member movably mounted to the holding member. Each of the terminals has a soldering portion projecting out of a bottom of the insulating housing for being soldered with the PCB. The holding member has a base slice projecting in front of the insulating housing. A bottom of the base slice extends downward to form an inserting slice. A portion of the inserting slice protrudes sideward to form a projection. The positioning member has a base portion. Two opposite ends of the base portion are bent sideward and then are extended toward each other to form a pair of clasping portions apart facing the base portion. The inserting slice of the holding member is inserted between the base portion and the clasping portions. A bottom of the base portion extends sideward oppositely to the clasping portions to form a soldering tail for being soldered with the PCB. A guiding slot is opened in the base portion and extends upward and downwards. The projection of the inserting slice is received in the guiding slot with intervals formed between the projection and a top and a bottom of the guiding slot, so that the positioning member can move up and down under the guidance and restraint of the projection, the guiding slot and the inserting slice to adjust a relative position between the soldering tail of the positioning member and the soldering portions of the terminals.

As described above, the inserting slice of the holding member is inserted between the base portion and the clasping portions of the positioning member, and the projection is received in the guiding slot with the intervals formed between the projection and the top and bottom of the guiding slot. As a result, the positioning member can move up and down under the guidance and restraint of the projection, the guiding slot and the inserting slice to adjust the soldering tail to keep level with the soldering portions of the terminals. So, the connector is able to keep the soldering portions of the terminals being soldered with the PCB even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
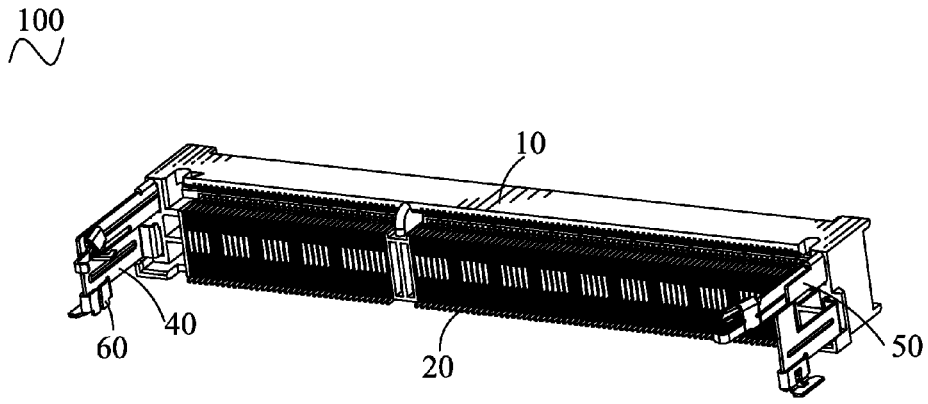
FIG. 1 is an assembled, perspective view of a connector of an embodiment in accordance with the present invention.
Figure 2:
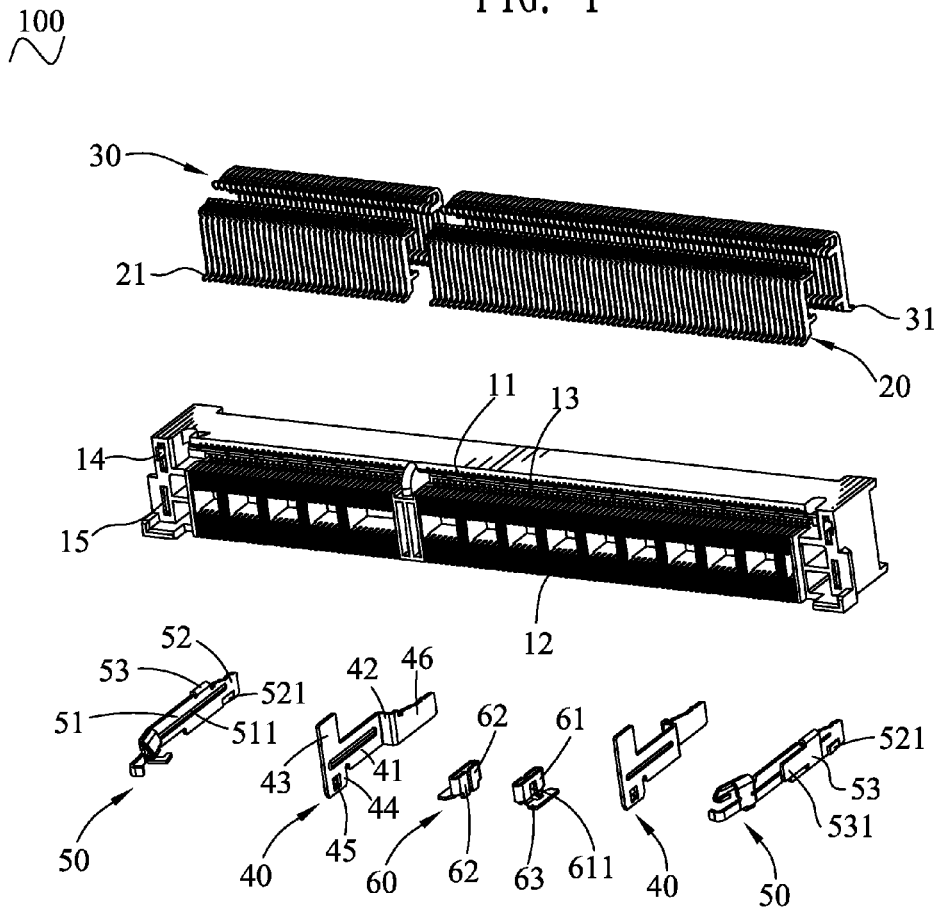
FIG. 2 is an exploded, perspective view of the connector shown in FIG. 1.

Referring to the drawings in greater detail, and first to FIGS. 1-2, the embodiment of the invention is embodied in a connector 100. The connector 100 includes an insulating housing 10, a plurality of first terminals 20 and second terminals 30 mounted in the insulating hosing 10, a pair of holding members 40 and a pair of latch members 50 mounted to two opposite ends of the insulating housing 10, and a pair of positioning members 60 movably assembled to the corresponding holding members 40.

Figure 3:
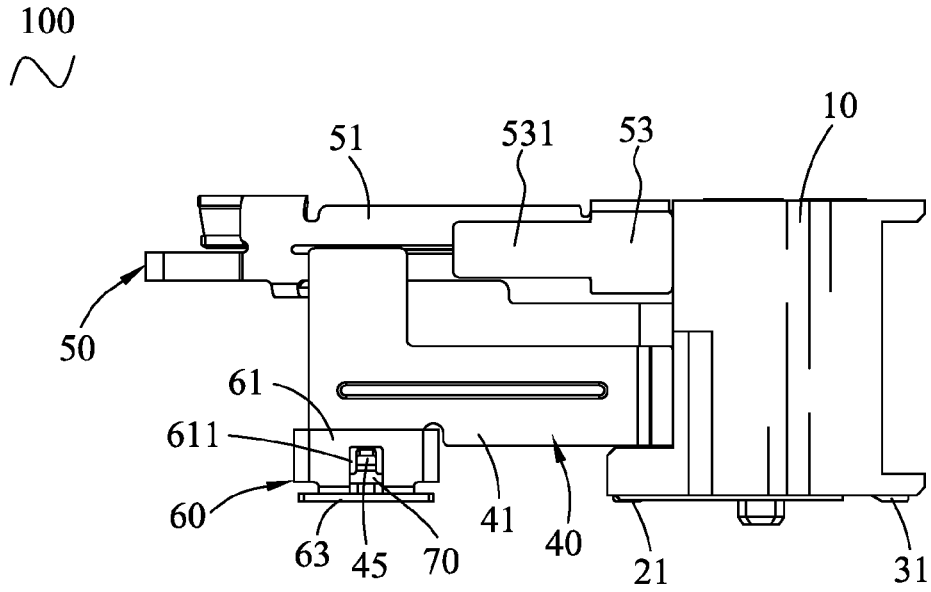
FIG. 3 is an assembled, lateral view of the connector shown in FIG. 1.

With reference to FIGS. 2-3, the insulating housing 10 of long rectangular shape has a front thereof recessed rearward to form a card recess 11 extending horizontally for receiving a card (not shown). A lower part of the insulating housing 10 defines a plurality of first recesses 12 arranged at regular intervals along a longwise direction thereof and communicating with the card recess 11. An upper part of the insulating housing 10 defines a plurality of second recesses 13 arranged at regular intervals along a longwise direction thereof and communicating with the card recess 11. Two opposite ends of the insulating housing 10 each has an upper portion recessed rearward to form a fixing recess 14, and a lower portion recessed rearward to form a holding recess 15. The holding recess 15 is parallel with the fixing recess 14.

The first terminals 20 are respectively assembled to the first recesses 12 and each has a first soldering portion 21 projecting out of a bottom of the insulating housing 10 for being soldered with a PCB (not shown). The second terminals 30 are respectively assembled to the second recesses 13 and each has a second soldering portion 31 projecting out of the bottom of the insulating housing 10 for being soldered with the PCB.

The holding member 40 has a long rectangular base slice 41. A rear of the base slice 41 extends sideward to form a connecting slice 42 perpendicular to the base slice 41. A free end of the connecting slice 42 extends perpendicularly and rearward to form a holding slice 46 parallel with the base slice 41. The holding slice 46 is inserted in the holding recess 15 for fixing the holding member 40 in the insulating housing 10 while the connecting slice 42 rests against the front of the insulating housing 10 for preventing the holding member 40 further going into the holding recess 15. A top of a front of the base slice 41 extends upward to form an extending slice 43. A bottom of the front of the base slice 41 extends downward to form an inserting slice 44. The inserting slice 44 has a middle portion thereof punched sideward to form a projection 45.

The latch member 50 has a long rectangular base plate 51. A rear of the base plate 51 extends rearward to form a fixing plate 52 press fitted in the fixing recess 14 of the insulating housing 10 with the base plate 51 projecting in front of the insulating housing 10. A portion of a top edge of the base plate 51 adjacent to the fixing plate 52 is extended sideward and then bent downward to form a folded plate 53 apart facing the base plate 51 and resting against the front of the insulating housing 10. A front of the folded plate 53 extends frontward to form a long rectangular elastic plate 531 apart parallel with the base plate 51. The extending slice 43 of the holding member 40 is located beside the latch member 50 and cooperates with the corresponding elastic plate 531 to prevent the deformation of the latch member 50 when the card is inserted into the card recess 11 of the connector 100. A middle of the base plate 51 is provided with a reinforcing rib 511 extending frontward and rearwards and crossing the whole base plate 51 for reinforcing the strength of the latch member 50. A portion of the fixing plate 52 is punched sideward to form a stab 521 slanting sideward. The stab 521 rests against a lateral side of the fixing recess 14 for fixing the latch member 50 firmly in the fixing recess 14.

The positioning member 60 has a rectangular board-shaped base portion 61 which is placed vertically. A middle of a bottom of the base portion 61 is recessed upward to form a guiding slot 611. The bottom of the base portion 61 extends sideward to form a soldering tail 63 perpendicular to the base portion 61. The guiding slot 611 further spreads sideward to the soldering tail 63. Two opposite ends of the base portion 61 are bent towards a side of base portion 61 opposite to the soldering tail 63, and then extend toward each other to form a pair of clasping portions 62 apart facing the base portion 61.

Figure 4:
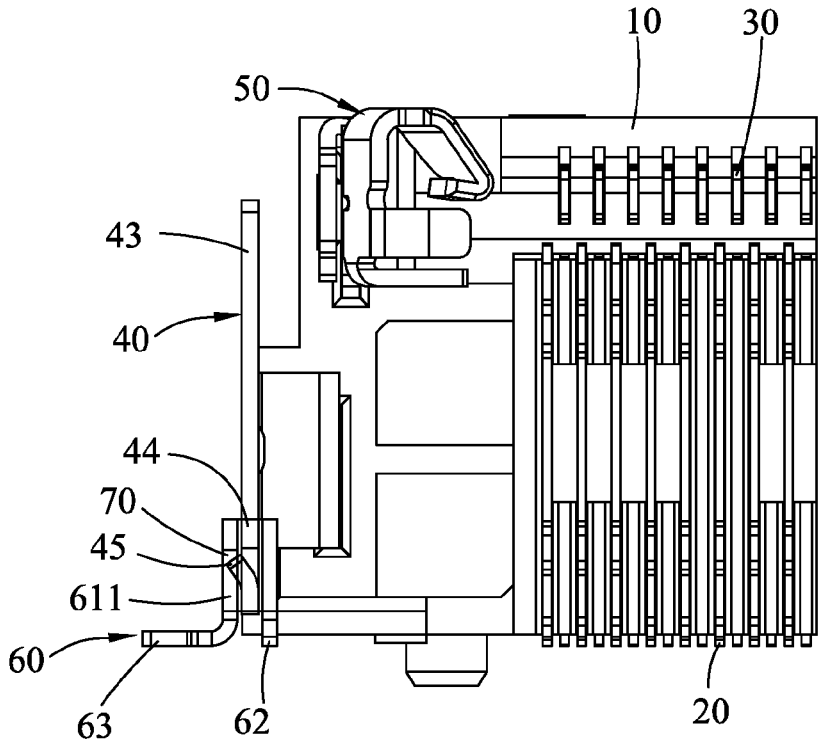
FIG. 4 is a cross-sectional view of the connector shown in FIG. 1.
Figure 5:
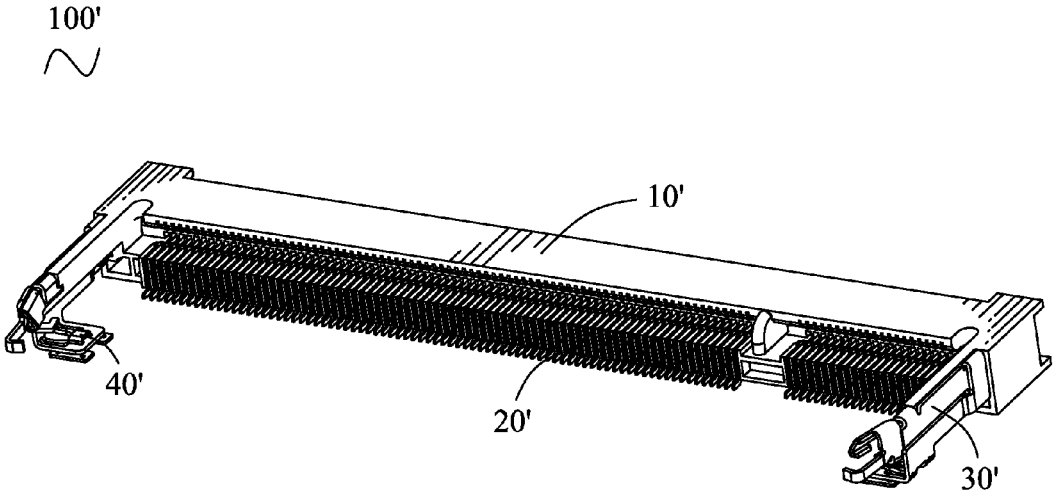
FIG. 5 (Prior Art)
FIG. 5 is an assembled, perspective view of a conventional connector.
Figure 6:
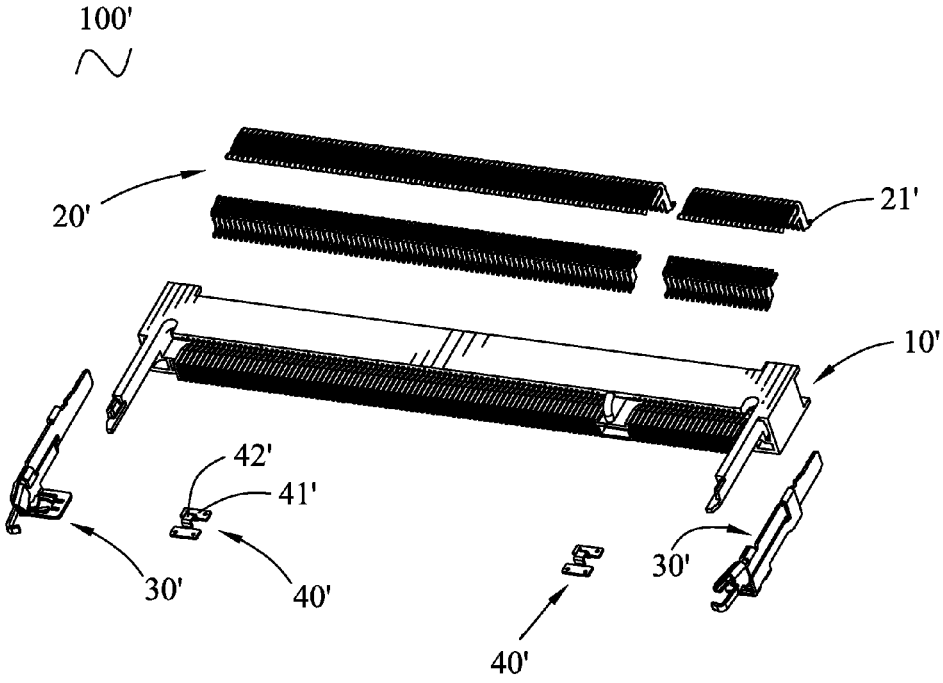
FIG. 6 (Prior Art)
FIG. 6 is an exploded, perspective view of the conventional connector shown in FIG. 5.

Referring to FIGS. 2-4, the positioning member 60 is movably assembled to the corresponding holding member 40 by means of the inserting slice 44 inserted between the base portion 61 and the clasping portions 62, and the projection 45 received in the guiding slot 611. The soldering tail 63 is soldered with the PCB. As there are intervals 70 between the projection 45 and a top and a bottom of the guiding slot 611, the positioning member 60 can move up and down under the guidance and restraint of the projection 45, the guiding slot 611 and the inserting slice 44 to adjust the soldering tail 63 to keep level with the soldering portions 21, 31 of the terminals 20, 30.

As described above, the inserting slice 44 of the holding member 40 is inserted between the base portion 61 and the clasping portions 62 of the positioning member 60, and the projection 45 is received in the guiding slot 611 with the intervals 70 formed between the projection 45 and the top and bottom of the guiding slot 611. As a result, the positioning member 60 can move up and down under the guidance and restraint of the projection 45, the guiding slot 611 and the inserting slice 44 to adjust the soldering tail 63 to keep level with the soldering portions 21, 31 of the terminals 20, 30. So, the connector 100 is able to keep the soldering portions 21, 31 of the terminals 20, 30 being soldered with the PCB even when there is tolerance in production.

What is claimed is:

1. A connector soldered to a PCB, comprising:

an insulating housing having two opposite ends of a front side thereof recessed rearward to form a pair of holding recesses;

a plurality of terminals assembled in the insulating housing, each of the terminals having a soldering portion projecting out of a bottom of the insulating housing for being soldered with the PCB;

a holding member inserted in the holding recess, the holding member having a base slice projecting in front of the insulating housing, a bottom of the base slice extending downward to form an inserting slice, a portion of the inserting slice being protruded sideward to form a projection; and a positioning member movably mounted to the inserting slice of the holding member, the positioning member having a base portion, two opposite ends of the base portion being bent sideward and then extending toward each other to form a pair of clasping portions apart facing the base portion, the inserting slice of the holding member being inserted between the base portion and the clasping portions, a bottom of the base portion extending sideward oppositely to the clasping portions to form a soldering tail for being soldered with the PCB, a guiding slot being opened in the base portion and extending upward and downward, the projection of the inserting slice being received in the guiding slot with intervals formed between the projection and a top and a bottom of the guiding slot, so that the positioning member can move up and down under the guidance and restraint of the projection, the guiding slot and the inserting slice to adjust a relative position between the soldering tail of the positioning member and the soldering portions of the terminals.

2. The connector as claimed in claim 1, further comprising a latch member having a base plate, a rear of the base plate extending rearward to form a fixing plate which is press fitted in a fixing recess opened in one end of the front side of the insulating housing and adjacent to the holding recess.

3. The connector as claimed in claim 2, wherein a middle portion of the base plate is provided with a reinforcing rib extending frontward and rearwards and crossing the whole base plate.

4. The connector as claimed in claim 2, wherein a portion of a top edge of the base plate adjacent to the fixing plate extends sideward and then is bent downward to form a folded plate resting against the front side of the insulating housing for preventing the latch member further going into the fixing recess.

5. The connector as claimed in claim 4, wherein a front of the folded plate extends frontward to form an elastic plate, and a portion of a top of the base slice of the holding member extends upward to form an extending slice located beside the latch member and cooperating with the elastic plate to prevent the deformation of the latch member.

6. The connector as claimed in claim 1, wherein a rear of the base slice extends sideward to form a connecting slice perpendicular to the base slice, a free end of the connecting slice further extends perpendicularly and rearward to form a holding slice parallel with the base slice, the holding slice is inserted in the holding recess and the connecting slice rests against the front side of the insulating housing.

* * * * *